US005701004A

United States Patent [19]

Nakaya

[11] Patent Number: 5,701,004

[45] Date of Patent: Dec. 23, 1997

[54] DRIVING CIRCUIT FOR ELECTRON MULTIPLYING DEVICES

[75] Inventor: Takanori Nakaya, Hamamatsu, Japan

[73] Assignee: Hamamatsu Photonics K.K., Shizuoka-ken, Japan

[21] Appl. No.: 527,536

[22] Filed: Sep. 13, 1995

[30] Foreign Application Priority Data

Sep. 13, 1994 [JP] Japan ..... 6-219015

[51] Int. Cl.[6] ..... H01J 40/14

[52] U.S. Cl. ..... 250/207; 313/103 R; 250/214 VT

[58] Field of Search ..... 250/214 VT, 207; 313/528, 530, 531, 532, 533, 534, 535, 536, 541, 542, 544, 103 R, 105 CM, 103 CM, 105 R, 104

[56] References Cited

U.S. PATENT DOCUMENTS

| | | | |
|---|---|---|---|
| 3,694,659 | 9/1972 | Ramsay et al. | 250/207 |
| 3,943,458 | 3/1976 | Cohn | 250/207 |
| 4,820,914 | 4/1989 | Allen | 250/207 |
| 5,453,610 | 9/1995 | Gibbons | 250/207 |
| 5,523,556 | 6/1996 | Meddaugh et al. | 250/214 VT |

*Primary Examiner*—Edward P. Westin
*Assistant Examiner*—John R. Lee
*Attorney, Agent, or Firm*—Sughrue,Mion,Zinn,Macpeak & Seas, PLLC

[57] ABSTRACT

A driving circuit for an electron multiplying device is provided which provides sufficient dynamic range and input-output linearity characteristic and reduces power loss to a greater extent. A cathode is set to a voltage substantially equal to the housing so that an electric field is not developed therebetween. A multiple stages of dynodes are arranged between the cathode and an anode, and a voltage multiplier is provided for applying bias voltages to the dynodes. The voltage multiplier includes a plurality of diodes and a plurality of capacitors. The capacitors are connected to respective ones of the dynodes individually to apply a voltage charged across each of the capacitors to the corresponding dynode. With such voltage multiplier, the dynodes are applied with voltages that increase with proximity of the subject dynode to the anode.

15 Claims, 9 Drawing Sheets

DRIVING CIRCUIT FOR ELECTRON MULTIPLYING DEVICES

BACKGROUND OF THE INVENTION

1. Field of the Invention

The present invention relates to electron multiplying devices including photomultipliers and electron multipliers, having plural stages of dynodes disposed between a cathode and an anode. More particularly, the invention relates to a driving circuit for powering the electron multiplying devices.

2. Description of the Prior Art

Conventional driving circuits for photomultipliers will be described with reference to FIGS. 1 through 3.

Referring first to the prior art shown in FIG. 1, the photomultiplier tube 1 has a photocathode C for emitting photoelectrons from its photoemissive surface, an anode P for collecting electrons and providing a signal current that is read out, and multiple stages of dynodes arranged between the photocathode C and the anode P. A driving circuit for this photomultiplier includes a high voltage power supply $V_H$ for applying a high voltage between the photocathode C and the anode P via a resistive load $R_L$, and a voltage-divider network having a plurality of resistors $R_1$ through $R_{n+1}$ connected in a series across the high voltage power supply $V_H$. The resistors $R_1$ through $R_{n+1}$ are provided in association with the respective ones of dynodes $D_1$ through $D_n$ individually, and the voltage divided by each of the resistors $R_1$ through $R_{n+1}$ is applied to the corresponding dynode $D_1$ through $D_n$. An a.c. voltage is developed across the resistive load $R_L$ by virtue of an anode current and the output signal is obtained through a coupling capacitor 2.

The driving circuit shown in FIG. 2 has a configuration such that the photocathode C is set to a negative high potential and the anode P to a ground potential. In contrast to the circuit of FIG. 2, the driving circuit of FIG. 1 has the photocathode C set to the ground potential and the anode to the positive high potential.

The driving circuit shown in FIG. 3 includes an a.c. power supply 3, a transformer 4 with primary and secondary windings of a predetermined wind number ratio, a first group capacitors $CA_1$ through $CA_{n+1}$, a second group capacitors $CB_1$ through $CB_{n+1}$, and rectifying diodes $d_1$ through $d_{2(n+1)}$.

The primary winding of the transformer 4 is connected to the a.c. power supply 3. Connected to one terminal T1 of the secondary winding of the transformer 4 are the series-connected second group capacitors $CB_1$ through $CB_{n+1}$. Connected to the other terminal T2 of the secondary winding are the series-connected first group capacitors $CA_1$ through $CA_{n+1}$. The first stage capacitor $CA_1$ in the first group is connected to the photocathode C and the final stage capacitor $CA_{n+1}$ is connected to a common ground GND of the photomultiplier 1.

Rectifying diodes $d_1$ through $d_{2(n+1)}$ are connected in series between the photocathode C and the terminal T2 of the secondary winding. Juncture points of the rectifying diodes are alternately connected to juncture points of the capacitors $CA_1$ through $CA_{n+1}$ and of capacitors $CB_1$ through $CB_{n+1}$ . The juncture points of the first group capacitors $CA_1$ through $CA_{n+1}$ are connected to corresponding dynodes $D_1$ through $D_n$.

The driving circuit rectifies the a.c. current appearing in the secondary winding of the transformer 4 with the respective rectifying diodes $d_1$ through $d_{2(n+1)}$ and sequentially charges the first and second group capacitors starting from the final stage capacitors $CA_{n+1}$ and $CB_{n+1}$ and ending with the initial stage capacitors $CA_1$ and $CB_1$. Upon completion of the charges to all the capacitors $CA_1$ through $CA_{n+1}$ and $CB_1$ through $CB_{n+1}$, the charged voltage in each of the capacitors excluding the capacitor $CB_{n+1}$ is brought to a voltage equal to a peak-to-peak voltage Vs of the a.c. voltage developed across the terminals T1 and T2 of the secondary winding. That is, the anode P is held to a high positive voltage (n×Vs) with respect to the photocathode voltage, thereby allowing the photomultiplier to perform electron multiplication. The anode current, which is produced from the multiplied electrons received at the anode P, is converted to a voltage signal at the resistive load $R_L$ and the a.c. component of the voltage signal is allowed to pass through the coupling capacitor 2.

Next, another conventional driving circuit will be described with reference to FIG. 4 in which the same components or parts as those in FIG. 3 will be designated by the same reference numeral as used in FIG. 3. The driving circuit of FIG. 4 includes a voltage stabilizer for stabilizing the voltages applied to dynodes $D_1$ through $D_n$ by a voltage multiplier composed of diodes $d_1$ through $d_{2(n+1)}$ and capacitors $CA_1$ through $CA_{n+1}$ and $CB_1$ through $CB_{n+1}$.

In the circuit of FIG. 4, an a.c. oscillation circuit 5 is provided for applying an a.c. current to the primary winding of the transformer 4, which includes a choke coil L, a resistor $r_1$, a pair of NPN transistors $Q_1$ and $Q_2$ connected in a push-pull configuration, and a capacitor $C_0$. A voltage stabilizer 6 is provided for applying a stabilized d.c. voltage to the a.c. oscillation circuit 5, which includes an NPN transistor $Q_3$ and an operational amplifier 7. As shown, a main power supply E1 is connected to the collector of the transistor $Q_3$, and an adjustable power supply E2 is connected to the photocathode C through resistors $r_2$ and $r_3$. A juncture point between the resistors $r_2$ and $r_3$ is connected to the non-inverting input terminal of the operational amplifier 7.

In operation, the operational amplifier 7 in the voltage stabilizer 6 detects a voltage variation in the photocathode C and controls the base potential of the transistor $Q_3$ so as to compensate the voltage variation in the photocathode C. The transistor $Q_3$ outputs a d.c. voltage, and based thereon the a.c. oscillation circuit 5 generates an a.c. current. Therefore, charges to the respective capacitors $CA_1$ through $CA_{n+1}$ and $CB_1$ through $CB_{n+1}$ with the stabilized voltages are ensured, and hence the dynodes $D_1$ through $D_n$ can achieve stable and highly accurate electron multiplying operations.

However, the above-described conventional driving circuits suffer from the following drawbacks. The driving circuits employing a voltage-divider network as shown in FIGS. 1 and 2 is disadvantageous in large power loss caused by a current flow in the voltage dividing resistors $R_1$ through $R_{n+1}$. If the current level flowing in the resistors is lowered to reduce the power loss, a dynamic range is lowered and the electron multiplying operation cannot be adequately performed. Further problem exists in that high intensity radiation causes a large anode current to flow from the anode P and this reduces the level of the current flowing in the voltage dividing resistors. As a result, a linearity of the output characteristic relative to the incident light is degraded.

In the driving circuits shown in FIGS. 3 and 4, strong electric field developed between the housing of photomultiplier 1 and the photocathode C deteriorates the photoemissive surface and increases output noises caused by illumination occurring when electrons impinge against the tubular wall held at the same potential as the common ground. The similar problems of the driving circuits of FIGS. 3 and 4 are also involved in the driving circuit of FIG. 2.

SUMMARY OF THE INVENTION

In view of the foregoing, the present invention has been made to solve the aforementioned problems, and accordingly it is an object of the invention to provide a driving circuit for an electron multiplier which does not adversely affect the dynamic range and linearlity and in which power loss can be greatly reduced and output noises can be largely suppressed.

To achieve the above and other objects, there is provided a driving circuit for an electron multiplying device, including a housing, a cathode, an anode, multiple stages of dynodes arranged between the cathode and anode, and voltage multiplying means. The cathode is set to a voltage substantially equal to the voltage at the housing so that an electric field is not developed therebetween. An anode is applied with a voltage higher than the voltage applied to the cathode. The voltage multiplying means includes a plurality of diodes and a plurality of capacitors. The capacitors are connected to respective ones of the dynodes individually to apply a voltage charged across each of the capacitors to the corresponding dynode wherein the dynodes are applied with voltages that increase with proximity of the subject dynode to the anode. The capacitors are connected in series between the cathode and the anode. In one embodiment, a power supplying means is connected to the capacitor corresponding to the dynode closest in position to the cathode.

In another embodiment, a power supplying means is coupled to the capacitor corresponding to the dynode closes in position to the anode. In this case, the capacitors are sequentially charged from the capacitor corresponding to the dynode closest to the anode to the capacitor corresponding to the dynode closest to the cathode. The power supplying means comprises an a.c. power supply for supplying an alternating current and a transformer, and the voltage multiplying means is electrically isolated from the a.c. power supply by the transformer. The transformer has a primary winding connecting the a.c. power supply and a secondary winding connecting the voltage multiplying means.

Preferably, a stabilizing circuit may be provided for stabilizing the voltages applied to the dynodes. The stabilizing circuit performs automatic control of the alternating current supplied from the a.c. power supply.

BRIEF DESCRIPTION OF THE DRAWINGS

The particular features and advantages of the invention as well as other objects will become more apparent from the following description taken in connection with the accompanying drawings, in which.

DETAILED DESCRIPTION OF THE PREFERRED EMBODIMENTS

Figure 5:
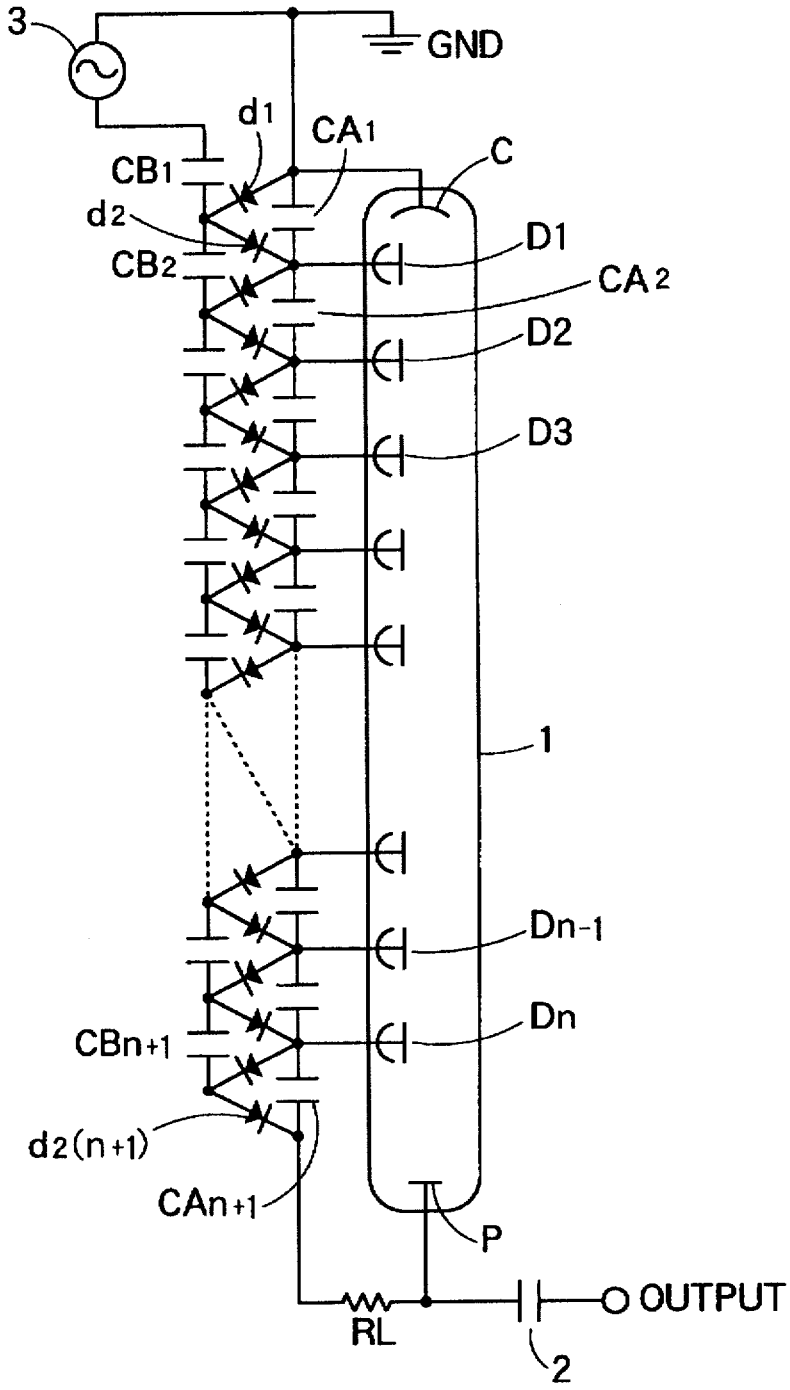
FIG. 5 is a circuit diagram of a driving circuit for a photomultiplier tube according to a first embodiment of the present invention.

A first embodiment of the present invention will be described with reference to FIG. 5. The first embodiment is directed to a driving circuit for a photomultiplier tube 1 having a photocathode C, an anode P and plural stages (n) of dynodes $D_1$ through $D_n$ disposed between the photocathode C and the anode P, which are confined within a vacuum tube. In the photomultiplier tube, photoelectrons are emitted from the photoemissive surface of the photocathode C and are successively multiplied at the dynodes $D_1$ through $D_n$ and collected at the anode P. The driving circuit includes an a.c. power source 3 for outputting an a.c. current, a first group capacitors $CA_1$ through $CA_{n+1}$, a second group capacitors $CB_1$ through $DB_{n+1}$, and rectifying diodes $d_1$ through $d_{2(n+1)}$, the latter three being provided corresponding to n-number dynodes $D_1$ through $D_n$.

The first group, (n+1)-number capacitors $CA_1$ through $CA_{n+1}$ are connected in series between the photocathode C and the anode P. The initial stage capacitor $CA_1$ and the photocathode C are connected to common ground GND. The a.c. power source 3 has one terminal connected to the common ground GND and another terminal to which series connection of the second group capacitors $CB_1$ through $CB_{n+1}$ is connected. The final stage capacitor $CB_{n+1}$ is connected to a resistive load $R_L$ through the final stage rectifying diode $d_{2(n+l)}$.

The rectifying diodes $d_1$ through $d_{2(n+1)}$ are alternately connected to juncture points of the first group capacitors $CA_1$ through $CA_{n+1}$ and to juncture points of the second group capacitors $CB_1$ through $CBn+_1$. Specifically, the capacitor $CA_1$ is connected between the photocathode C and the first stage dynode $D_1$, and a series connection of the rectifying diodes $d_1$ and $d_2$ is connected across the capacitor $CA_1$. A juncture point of the diodes $d_1$ and $d_2$ is connected to a juncture point of the capacitors $CB_1$ and $CB_2$. A capacitor $CA_2$ is connected between the dynodes $D_1$ and $D_2$, and the series connection of the rectifying diodes $d_3$ and $d_4$ is connected across the capacitor $CA_2$. A juncture point of the diodes $d_3$ and $d_4$ is connected to a juncture point of the capacitors $CB_2$ and $CB_3$. The remaining rectifying diodes $D_5$ through $d_{2n}$, capacitors $CA_3$ through $CA_n$ and $CB_3$ through $CB_n$ are also connected to the dynodes $D_3$ through $D_n$ in the same fashion. Between the final stage dynode Dn and the resistive load $R_L$ is connected a capacitor $CA_{n+1}$, and the series connection of the rectifying diodes $d_{2n+1}$ and $d_{2(n+1)}$ is connected across the capacitor $CA_{n+1}$.

The juncture points of the first group capacitors $CA_1$ through $CA_{n+1}$ are connected in one-to-one correspondence to the dynodes $D_1$ through $D_n$. An anode current resulting from collection of the multiplied electrons at the anode P is translated into a voltage signal at the resistive load $R_L$. The a.c. component of the voltage signal is output through a coupling capacitor 2.

According to the driving circuit thus constructed, the a.c. current output from the a.c. power source 3 is sequentially charged from the first stage capacitors $CA_1$ and $CB_1$ to the final stage capacitors $CA_{n+1}$ and $CB_{n+1}$ by virtue of the rectification of the diodes $d_1$ through $d_{2(n+1)}$. Therefore, the respective dynodes $D_1$ through $D_n$ are applied with relevant voltages, and the anode voltage can be maintained at a voltage higher than the photocathode voltage, thereby allowing the photomultiplier tube 1 to perform an electron multiplying operation.

Figure 1:
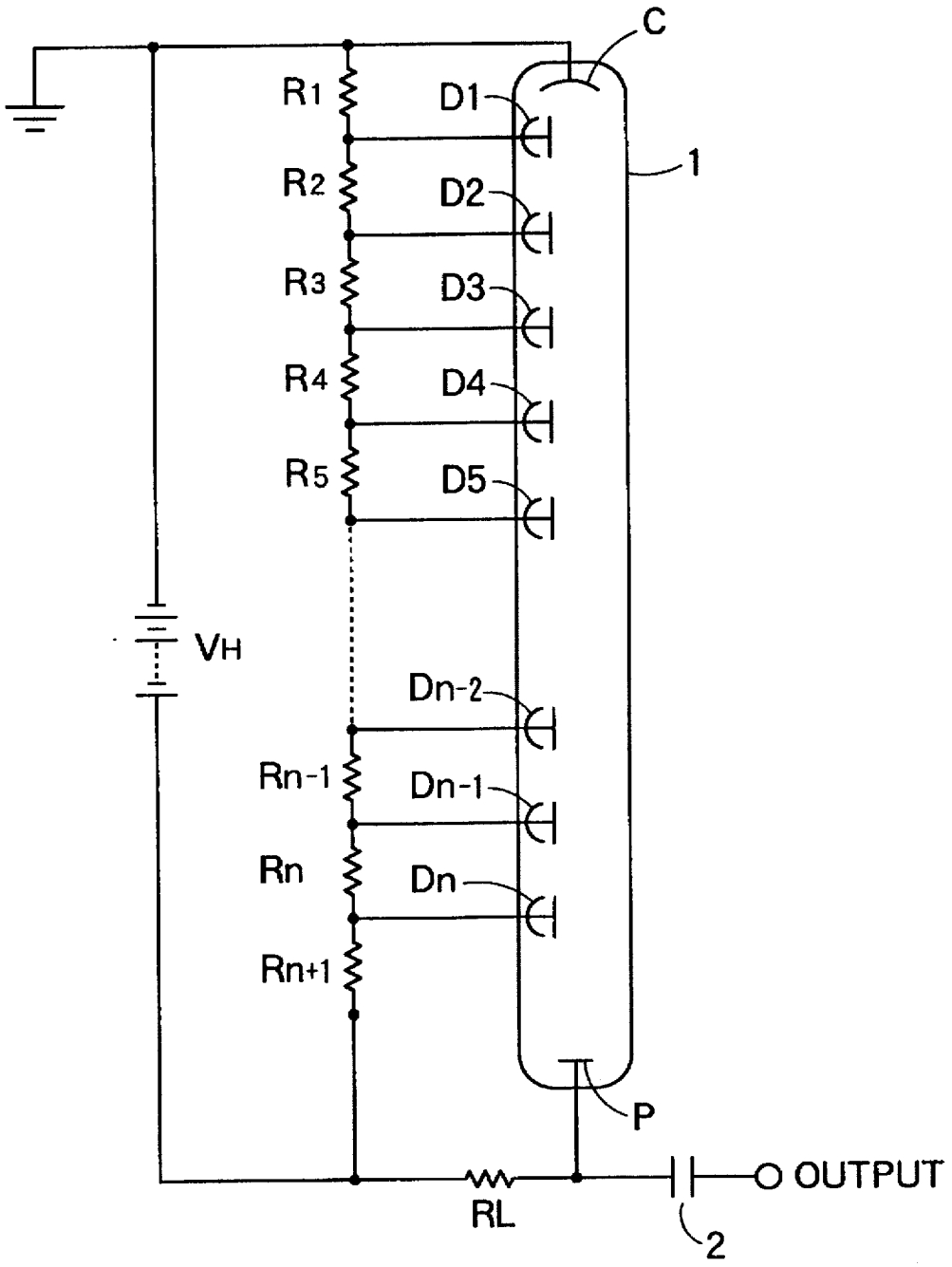
FIG. 1 PRIOR ART
FIG. 1 is a circuit diagram of a conventional driving circuit for a photomultiplier tube.

Unlike the conventional voltage-division type driving circuit shown in FIG. 1, the first embodiment does not use voltage division resistors, so that the power loss can be lessened to a greater extent, the photomultiplier tube 1 is free from decrease of the dynamic range, and linearlity can be maintained.

Figure 2:
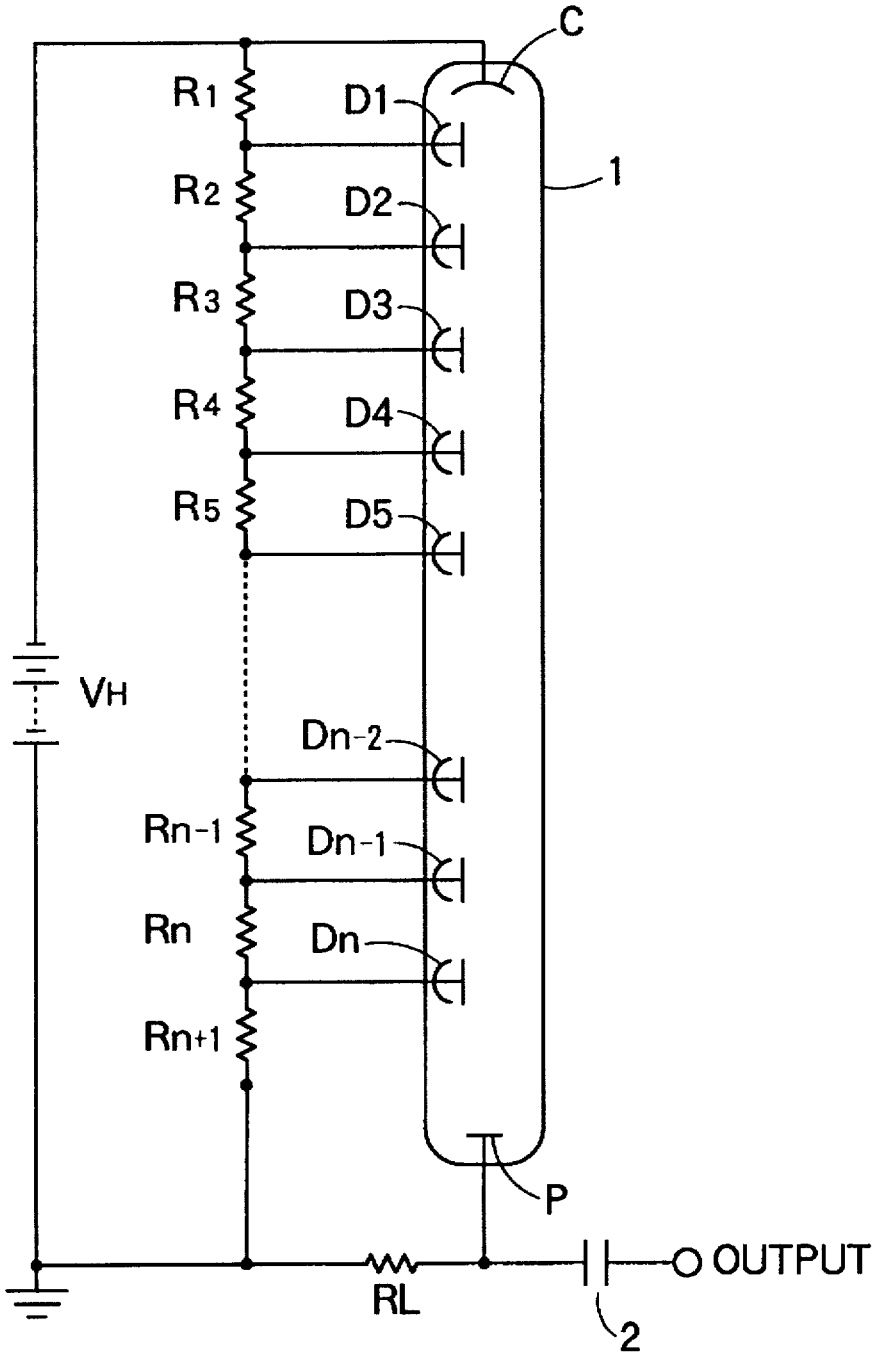
FIG. 2 PRIOR ART
FIG. 2 is a circuit diagram of another conventional driving circuit for a photomultiplier tube.
Figure 3:
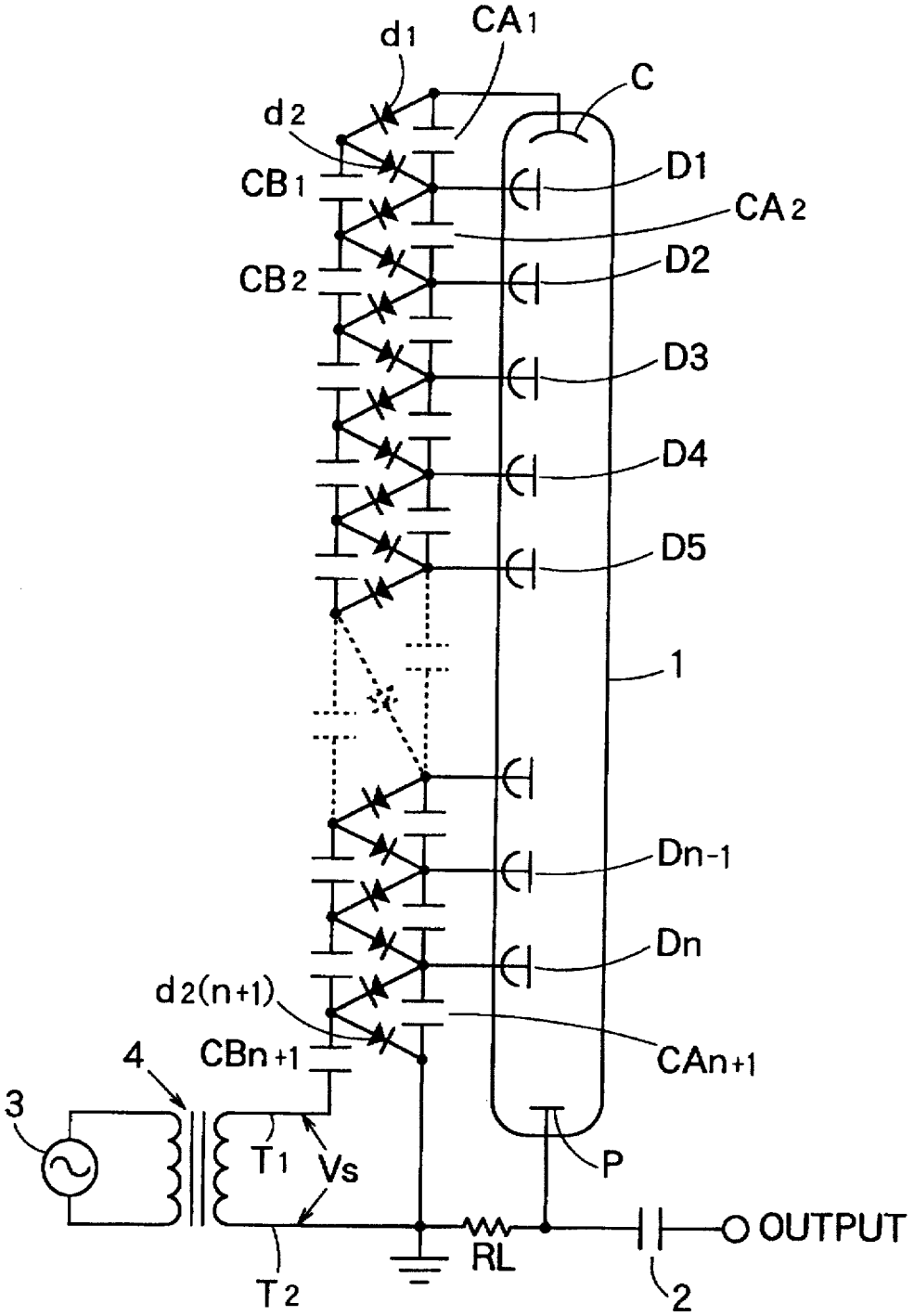
FIG. 3 PRIOR ART
FIG. 3 is a circuit diagram of still another conventional driving circuit for a photomultiplier tube.
Figure 4:
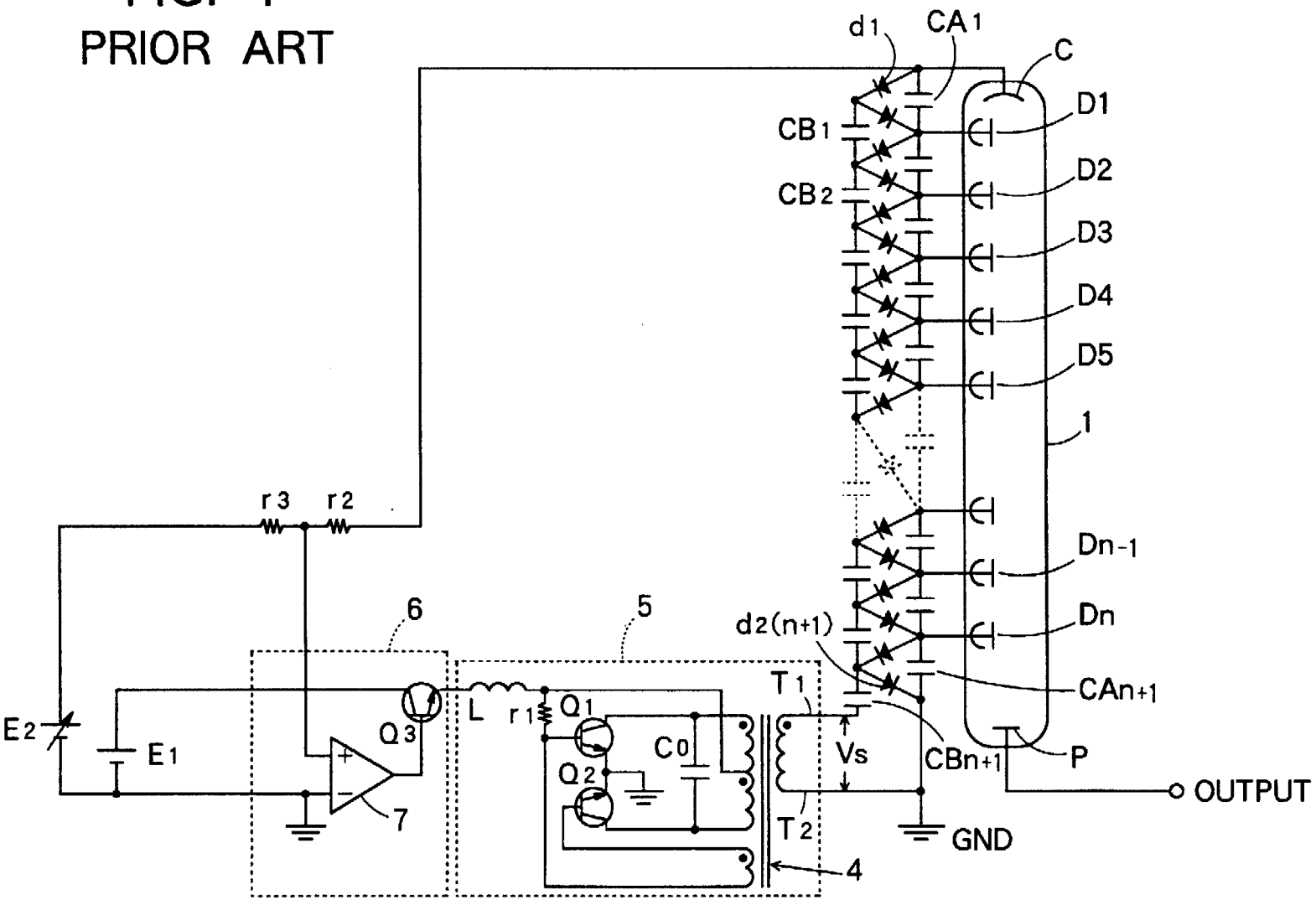
FIG. 4 PRIOR ART
FIG. 4 is a circuit diagram of yet another conventional driving circuit for a photomultiplier tube.

Further, the photocathode C is set to a voltage equal to that of the common ground GND. Therefore, the following advantageous effects can be obtained. In the conventional driving circuits shown in FIGS. 2 and 3, the anode P is set to a potential equal to that of a common ground GND to which a housing is set, and the photocathode C is set to a negative potential. As a result, a strong electric field yields between the housing of the photomultiplier tube 1 or the photoemissive surface and the photocathode C. This results in degradation of the photoemissive surface and increase of output noises. The output noises increase because of occurrence of illumination by the impingement of electrons against the side wall of the tube. According to the first embodiment, the photocathode C is connected to the housing which is set to common ground GND, strong electric field does not yield and accordingly degradation of the photoemissive surface and increase of the output noise do not occur.

Figure 9A:
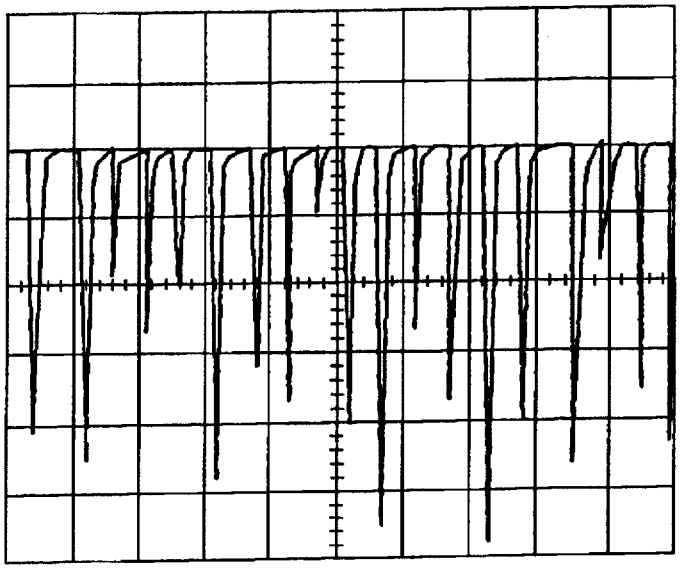
FIGS. 9(A) and 9(B) is an explanatory diagram for illustrating advantageous effects of the first through fourth embodiment of the present invention.
Figure 9B:
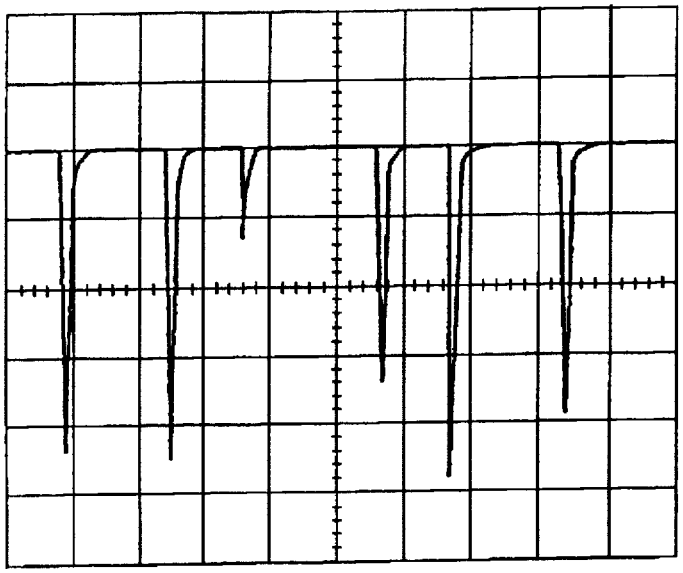

FIGS. 9A and 9B are oscilloscopic noise waveforms from anode-grounded and cathode-grounded photomultiplier tubes, respectively, where the axis of abscissas represents time and axis of ordinates voltage. From the measurement results, it is experimentally confirmed that the cathode-ground is more advantageous than the anode-ground.

Figure 6:
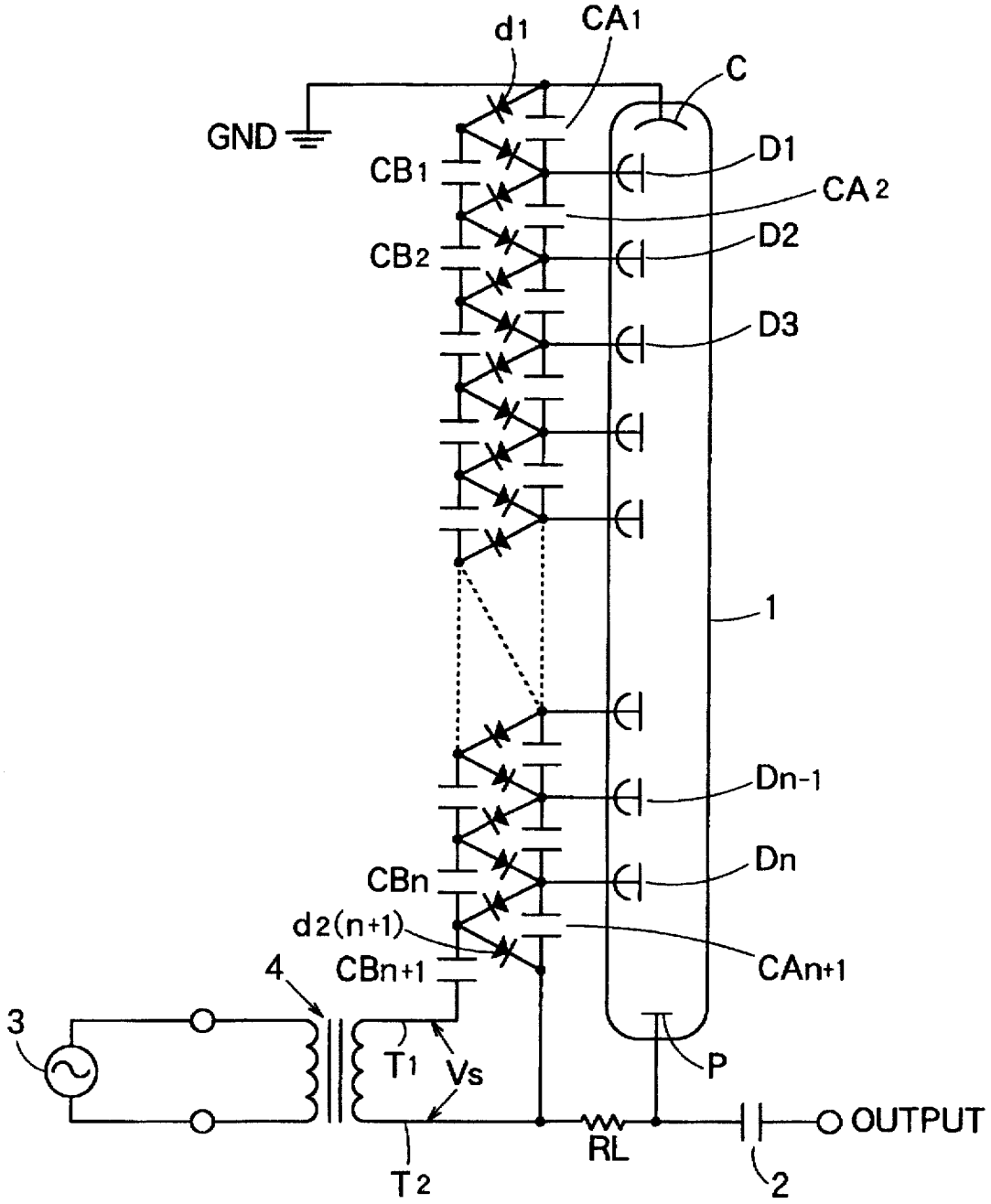
FIG. 6 is a circuit diagram of a driving circuit for a photomultiplier tube according to a second embodiment of the present invention.

A second embodiment of the present invention will next be described with reference to FIG. 6 in which the same reference numerals as used in FIG. 5 will be used to denote the same or corresponding components.

The second embodiment is similar to the first embodiment in that the photocathode C is connected to the common ground GND which is held in the same potential as the housing of the photomultiplier tube 1. However, the second embodiment differs from the first embodiment in that the power source 3 and the transformer 4 are connected to the final stage, anode-side capacitors $CA_{n+1}$ and $CB_{n+1}$ so as to charge the voltage multiplier composed of diodes $d_1$ through $d_{2(n+1)}$ and capacitors $CA_1$ through $CA_{n+1}$ and $CB_1$ through $CB_{n+1}$, and in that the initial stage capacitors $CA_1$ and $CB_1$ are directly connected to the common ground GND. An a.c. current produced at an anode flows in a resistive load $R_L$ connected between the final stage capacitor $CA_{n+1}$ and the anode P and is output through a coupling capacitor 2.

According to the driving circuit of the second embodiment, the capacitors are sequentially charged from the final stage, anode-side capacitors $CA_{n+1}$ and $CB_{n+1}$ toward the initial stage capacitors $CA_1$ and $CB_1$. Because the power source and the voltage multiplier are electrically insulated through the transformer 4, the capacitors $CA_1$ through $CA_{n+1}$ and $CB_1$ through $CB_{n+1}$ are charged so that the photocathode C has the lowest potential and the anode P has the highest potential. As a result, the respective dynodes $D_1$ through $D_n$ are applied with relevant voltages, thereby allowing the photomultiplier tube 1 to perform electron multiplication.

Further, the photocathode is set to a potential equal to the common ground GND, the advantageous effects as obtained in the first embodiment are also obtainable. Specifically, because the photocathode C is connected to the common ground GND or the housing, a strong electric field does not yield between these components. Therefore, the photoemissive surface is free from degradation and the output noise does not increase. Incidentally, as is the case of FIG. 3, reduction of output noise is experimentally confirmed. Furthermore, because the number of multiplied electrons increases as compared with the first embodiment and because charging starts from the capacitors in association with the final stage dynode which requires an increased amount of energy for electron multiply, high charging efficiency, well-organized driving circuit can be provided.

Figure 7:
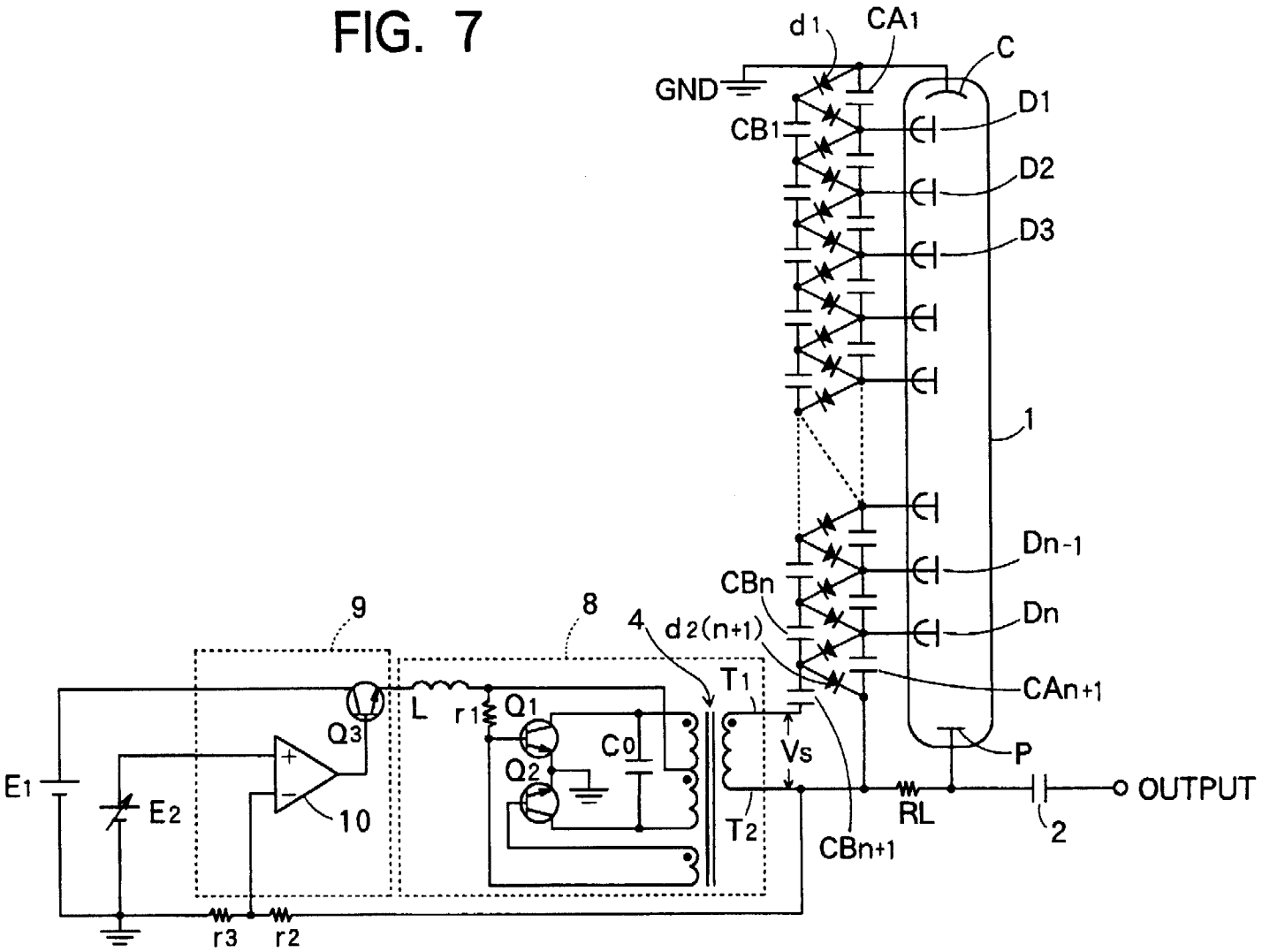
FIG. 7 is a circuit diagram of a driving circuit for a photomultiplier tube according to a third embodiment of the present invention.

A third embodiment of the present invention will be described with reference to FIG. 7 in which the same reference numerals as used in FIG. 6 will be used to denote the same or corresponding components.

The third embodiment is similar to the second embodiment in that the photocathode C is connected to the common ground GND which is set to the same potential as the housing of the photomultiplier tube 1, and that the voltage multiplier composed of diodes $d_1$ through $d_{2(n+1)}$ and capacitors $CA_1$ through $CA_{n+1}$ and $CB_1$ through $CB_{n+1}$ is charged from the final-stage, anode-side capacitors $CA_{n+1}$ and $CB_{n+1}$. The third embodiment is unique in the incorporation of a voltage stabilizer for stabilizing voltages developed by the voltage multiplier and applied to the dynodes $D_1$ through $D_n$. An a.c. oscillation source 8 and a stabilizer 9 are further provided. The a.c. oscillator 8 supplies an a.c. current to the transformer 4 connected to the voltage multiplier. The stabilizer 9 performs automatic control of the a.c. current supplied from the a.c. oscillation source 8.

The a.c. oscillation source 8 includes a capacitor $C_0$ and a pair of NPN transistors $Q_1$ and $Q_2$. The capacitor $C_0$ is connected across the first primary winding of the transformer 4 and the pair of the NPN transistors $Q_1$ and $Q_2$ are also connected thereacross. The transistor $Q_1$ has a base connected through the resistor $r_1$ to the intermediate terminal of the first primary winding and also connected to one end of the second primary winding. The counterpart transistor $Q_2$ has a base connected to the other end of the second primary winding. The intermediate terminal of the first primary winding is applied with a d.c. voltage from the stabilizer 9 through a choke coil L. With such an arrangement, the pair of the NPN transistors $Q_1$ and $Q_2$ performs push-pull operation in accordance with directions of currents flowing in the first and second primary windings. As a result, an a.c. current flows in the secondary winding of the transformer 4, allowing the voltage multiplier to be charged.

The stabilizer 9 includes an NPN transistor $Q_3$ connected to the choke coil L and an operational amplifier 10. The NPN transistor $Q_3$ has a collector connected to a voltage source E which supplies a predetermined voltage, and a base connected to the output terminal of the operational amplifier 10. The operational amplifier 10 has a non-inverting terminal connected to a variable voltage source $E_2$, and an inverting terminal connected, on one hand, to the terminal $T_2$ of the secondary winding of the transformer 4 via a resistor $r_2$ and, on the other hand, to the common ground GND via a resistor $r_3$. The resistors $r_2$ and $r_3$ serve as a high voltage divider which performs voltage division of the voltage developed at the terminal $T_2$ of the secondary winding of the transformer 4 and the voltage developed across the resistor $r_3$ is applied to the inverting input terminal of the operational amplifier 10. By varying the voltage of the variable voltage source $E_2$, the voltage applied to the non-inverting input terminal of the operational amplifier 10 can be varied. In order that the voltage applied to the inverting input terminal falls within an operable range of the operational amplifier 10, the resistance of the resistor $r_2$ is determined to be sufficiently greater than that of the resistor $r_3$. The stabilizer 9 detects the bias voltage variation at the anode P with the operation of the operational amplifier 10. To suppress the variable contained in the bias voltage variation, the stabilizer 9 performs automatic adjustment of the base potential of the NPN transistor $Q_3$. In accordance with the d.c. voltage (or current) outputted from the transistor $Q_3$, the a.c. oscillator source 8 produces an a.c. current. As such, a stabilized voltage can be supplied to the respective capacitors making up the voltage multiplier for charging, thus allowing the dynodes $D_1$ through $D_n$ to perform stabilized and high precision electron multiplying operations.

Like the first and second embodiments, the third embodiment has an arrangement such that the photocathode C is set to the potential of the common ground GND same as the potentials of the housing, so that no strong electric field yields between these components. As a result, photoemissive surface degradation free effects can be obtained and there is no problem in terms of increasing the output noise. Such advantageous effects are also experimentally proven.

Figure 8:
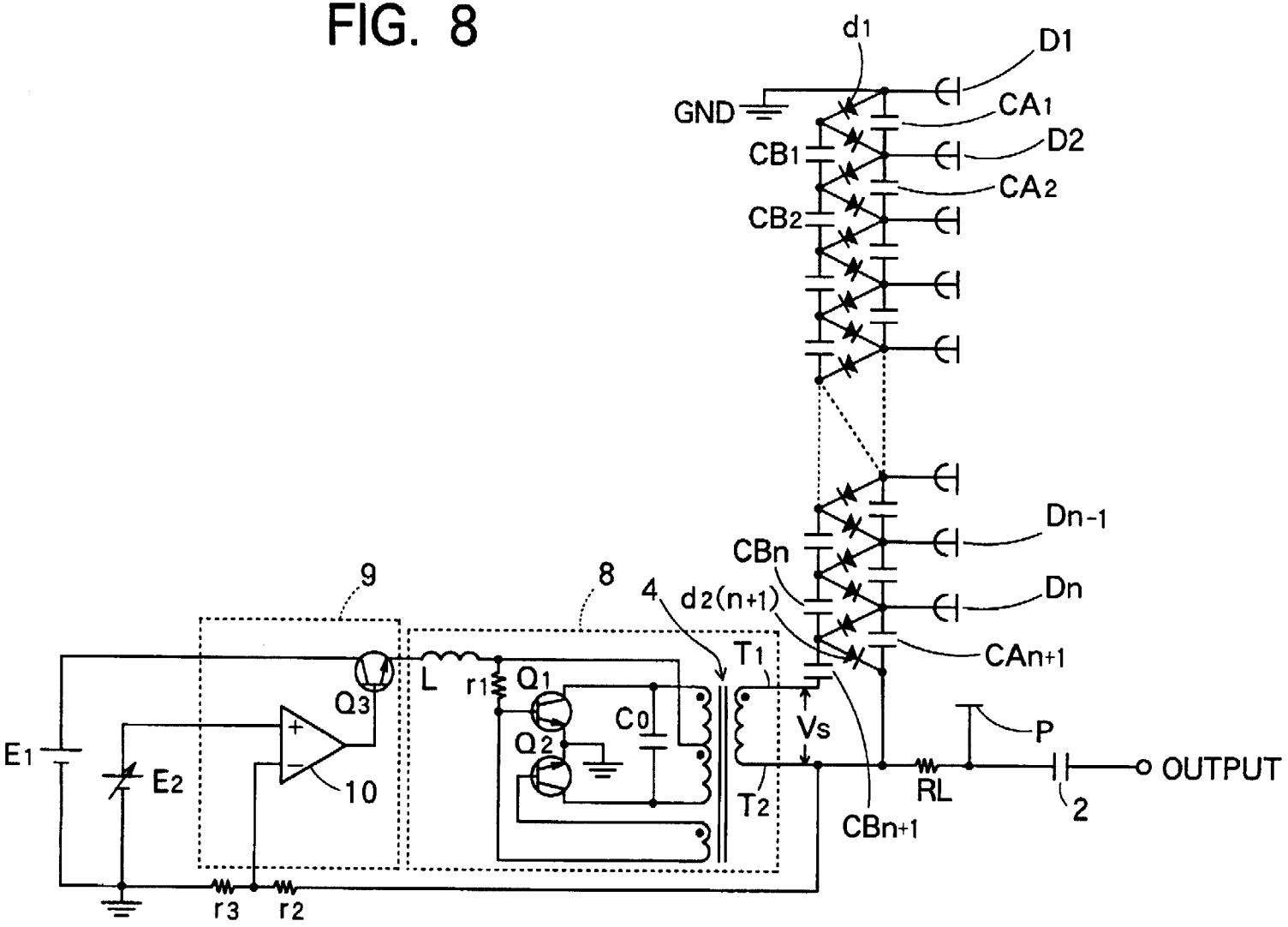
FIG. 8 is a circuit diagram of a driving circuit for a photomultiplier tube according to a fourth embodiment of the present invention.

A fourth embodiment of the present invention will be described while referring to FIG. 8 in which the same reference numerals as used in FIG. 7 will be used to denote the same or corresponding components. The fourth embodiment is directed to an electronic multiplier tube having a driving circuit shown in FIG. 7. Unlike photomultiplier tubes, the electronic multiplier tubes are operated in a vacuum and are capable of directly detecting ion, electron and X-ray. The driving circuit for the photomultiplier tube can also be used in the electron multiplier tubes because dynodes and anode of the electron multiplier tubes are same in structure to that of the photomultiplier tubes. The driving circuits according to the first to third embodiments are also applicable to the electron multiplier tubes.

What is claimed is:

1. A driving circuit for an electron multiplying device, comprising:

a housing having a first voltage equal to a ground level;

a cathode set to a voltage substantially equal to said ground level so that an electric field is not developed between said housing and said cathode;

an anode applied with a second voltage higher than said first voltage;

multiple stages of dynodes arranged between said cathode and said anode; and voltage multiplying means, including a plurality of diodes and a plurality of capacitors, said plurality of capacitors being connected to respective ones of said multiple stages of dynodes individually, for applying a voltage charged across each of said plurality of capacitors to a corresponding dynode wherein said multiple stages of dynodes are applied with voltages that increase with proximity of a dynode to said anode.

2. A driving circuit according to claim 1, wherein said plurality of capacitors are connected in series between said cathode and said anode.

3. A driving circuit according to claim 2, further comprising a power supply connected to a capacitor corresponding to a dynode closest in position to said cathode.

4. A driving circuit according to claim 2, wherein said plurality of capacitors are sequentially charged from a capacitor corresponding to a dynode closest to said anode to a capacitor corresponding to a dynode closest to said cathode.

5. A driving circuit according to claim 3, further comprising power supplying means, coupled to said capacitor corresponding to said dynode closest in position to said anode, for supplying power to said voltage multiplying means.

6. A driving circuit according to claim 5, wherein said power supplying means comprises an a.c. power supply for supplying an alternating current, and a transformer, and wherein said voltage multiplying means is electrically isolated from said a.c. power supply by said transformer.

7. A driving circuit according to claim 6, wherein said transformer has a primary winding connected to said a.c. power supply and a secondary winding connected to said voltage multiplying means.

8. A driving circuit according to claim 7, further comprising a stabilizing circuit for stabilizing voltages applied to said multiple stages of dynodes.

9. A driving circuit according to claim 8, wherein said stabilizing circuit performs automatic gain control of said alternating current supplied from said a.c. power supply.

10. A driving circuit for an electron multiplying device, comprising:

a housing connected to ground;

a cathode connected to said ground so that an electric field is not developed between said housing and said cathode;

an anode applied with a positive voltage;

n-dynodes arranged between said cathode and said anode, where n is an integer; and a voltage multiplying circuit comprising 2(n+1)-diodes, first (n+1)-capacitors, second (n+1)-capacitors, a load resistor, and an a.c. voltage source;

wherein said 2(n+1)-diodes, said first (n+1)-capacitors, and said second (n+1)-capacitors are configured to form a Cockcroft-Walton circuit to develop voltages to respective ones of said first (n+1)-capacitors, said first (n+1)-capacitors being connected in series between said cathode and said anode so that first to n-th capacitors of said first (n+1)-capacitors apply voltages to respective ones of said n-dynodes individually, said first capacitor of said first (n+1)-capacitors being connected to said ground, said second (n+1)-capacitors being connected in series between said a.c. power source and said anode through said load resistor, said 2(n+1)-diodes being connected to said first (n+1)-capacitors and said second (n+1)-capacitors in a ladder configuration.

11. A driving circuit according to claim 10, wherein an (n+1)th capacitor of said second (n+1)-capacitors is connected to said load resistor via a 2(n+1)th diode of said 2(n+1)-diodes.

12. A driving circuit for an electron multiplying device, comprising:

a housing connected to ground;

a cathode connected to said ground so that an electric field is not developed between said housing and said cathode;

an anode applied with a positive voltage;

n-dynodes arranged between said cathode and said anode, where n is an integer; and a voltage multiplying circuit comprising 2(n+1)-diodes, first (n+1)-capacitors, second (n+1)-capacitors, a load resistor, and an a.c. voltage source;

wherein said 2(n+1)-diodes, said first (n+1)-capacitors, and said second (n+1)-capacitors are configured to form a Cockcroft-Walton circuit to develop voltages to respective ones of said first (n+1)-capacitors, said first (n+1)-capacitors being connected in series between said cathode and said anode so that first to n-th capacitors of said first (n+1)-capacitors apply voltages to respective ones of said n-dynodes individually, said first capacitor of said first (n+1)-capacitors being connected to said ground, said second (n+1)-capacitors being connected in series between said a.c. power source and said ground, said 2(n+1)-diodes being connected to said first (n+1)-capacitors and said second (n+1)-capacitors in a ladder configuration, wherein said a.c. voltage source is connected to one of said second (n+1)-capacitors such that said first (n+1)-capacitors and said second (n+1)-capacitors are charged from a capacitor corresponding to a dynode closest in position to said anode to a capacitor corresponding to a dynode closest in position to said cathode.

13. A driving circuit for an electron multiplying device, comprising:

a housing connected to ground;

a cathode connected to said ground so that an electric field is not developed between said housing and said cathode;

an anode applied with a positive voltage;

n-dynodes arranged between said cathode and said anode, where n is an integer; and a voltage multiplying circuit comprising 2(n+1)-diodes, first (n+1)-capacitors, second (n+1)-capacitors, a load resistor, and an a.c. voltage source;

wherein said 2(n+1)-diodes, said first (n+1)-capacitors, and said second (n+1)-capacitors are configured to form a Cockcroft-Walton circuit to develop voltages to respective ones of said first (n+1)-capacitors, said first (n+1)-capacitors being connected in series between said cathode and said anode so that first to n-th capacitors of said first (n+1)-capacitors apply voltages to respective ones of said n-dynodes individually, said first capacitor of said first (n+1)-capacitors being connected to said ground, said second (n+1)-capacitors being connected in series between said a.c. power source and said ground, said 2(n+1)-diodes being connected to said first (n+1)-capacitors and said second (n+1)-capacitors in a ladder configuration, wherein said a.c. voltage source is connected to one of said second (n+1)-capacitors such that said first (n+1)-capacitors and said second (n+1)-capacitors are charged from a capacitor corresponding to a dynode closest in position to said anode to a capacitor corresponding to a dynode closest in position to said cathode, wherein said a.c. voltage source comprises a stabilizer circuit and an a.c. oscillation signal generator connected to said one of said second (n+1)-capacitors, and a stabilizer circuit which performs automatic gain control of an alternating current supplied from said a.c. oscillation signal generator.

14. A driving circuit for an electron multiplier tube, comprising:

a housing connected to ground;

a cathode connected to said ground so that an electric field is not developed between said housing and said cathode;

an anode applied with a positive voltage;

n-dynodes arranged between said cathode and said anode, where n is an integer; and a voltage multiplying circuit comprising 2(n+1)-diodes, first (n+1)-capacitors, second (n+1)-capacitors, a load resistor, and an a.c. voltage source;

wherein said 2(n+1)-diodes, said first (n+1)-capacitors, and said second (n+1)-capacitors are configured to form a Cockcroft-Walton circuit to develop voltages to respective ones of said first (n+1)-capacitors, said first (n+1)-capacitors being connected in series between said cathode and said anode so that first to n-th capacitors of said first (n+1)-capacitors apply voltages to respective ones of said n-dynodes individually, said first capacitor of said first (n+1)-capacitors being connected to said ground, said second (n+1)-capacitors being connected in series between said a.c. power source and said ground, said 2(n+1)-diodes being connected to said first (n+1)-capacitors and said second (n+1)-capacitors in a ladder configuration, wherein said a.c. voltage source is connected to one of said second (n+1)-capacitors such that said first (n+1)-capacitors and said second (n+1)-capacitors are charged from a capacitor corresponding to a dynode closest in position to said anode to a capacitor corresponding to a dynode closest in position to said cathode.

15. A driving circuit for an electron multiplier tube according to claim 14, wherein said a.c. voltage source comprises a stabilizer circuit and an a.c. oscillation signal generator connected to said one of said second (n+1)-capacitors, and a stabilizer circuit which performs automatic gain control of an alternating current supplied from said a.c. oscillation signal generator.

* * * * *